United States Patent [19]

Collins

[11] Patent Number: 4,993,126

[45] Date of Patent: Feb. 19, 1991

[54] TOWEL HOLDERS FOR LOUNGE CHAIRS

[76] Inventor: John W. Collins, 2853 N. 122nd St., Wauwatosa, Wis. 53222

[21] Appl. No.: 522,919

[22] Filed: May 14, 1990

[51] Int. Cl.[5] ..... A44B 21/00; A47H 13/00

[52] U.S. Cl. ..... 24/336; 24/563; 211/124

[58] Field of Search ..... 24/336, 337, 335, 265 C, 24/561, 562, 563; 211/124; 248/74.2

[56] References Cited

U.S. PATENT DOCUMENTS

| | | | |
|---|---|---|---|
| 161,138 | 3/1875 | Mayo | 24/561 |
| 183,812 | 10/1876 | Mayo | 24/562 |
| 679,542 | 7/1901 | Peats | 24/346 |
| 723,454 | 3/1903 | Foster | 24/336 |
| 974,865 | 11/1910 | Dreher | 24/336 |
| 1,640,278 | 8/1927 | Johnson et al. | 24/336 |
| 2,543,336 | 2/1951 | Ratchford | 24/561 |
| 2,960,742 | 11/1960 | Solomon | 24/561 |
| 3,171,179 | 3/1965 | Lee | 24/336 |
| 4,934,540 | 6/1990 | Novak | 24/563 |

FOREIGN PATENT DOCUMENTS

| | | | |
|---|---|---|---|
| 460985 | 11/1949 | Canada | 24/265 C |
| 0378422 | 8/1932 | United Kingdom | 24/336 |

*Primary Examiner*—Victor N. Sakran

*Attorney, Agent, or Firm*—James L. Kirschnik

[57] ABSTRACT

A holder for securing towels or other sheet-like products includes a space for receiving a strap of a lounge chair and a cavity for receiving and retaining a towel advanced longitudinally into place within the holder cavity. A protruding holding ridge at the cavity entrance prevents removal of the towel from the holder once inserted in a longitudinal direction but permits removal in a lateral direction.

10 Claims, 1 Drawing Sheet

TOWEL HOLDERS FOR LOUNGE CHAIRS

BACKGROUND OF THE INVENTION

1. Field of The Invention

This invention relates to devices for securing towels to chaise lounge chairs or similar furniture such as outdoor furniture for sun bathers. A brief description is set forth in my disclosure document No. 247,476 filed Mar. 12, 1990.

2. Description of the Prior Art

Persons who typically use lounge chairs around beaches, swimming pools, or the like, will often provide a towel on the chair surface. This is done because it provides a sanitary and comfortable insulation between the user and the chair. A towel can also provide an absorbing surface when the user is moist with sun screen, perspiration or wet from swimming. In the past various methods of holding the towel to the chairs have been attempted such as intertwining the ends of the towel between support straps of the lounge chair or the use of clips attached to the top of the chair frame. Applicant is not aware of any similar devices which are suitable for effectively retaining a towel in place on a lounge chair against forces such as wind, shifting of the user's body while getting in and out of the chair or during movement on the chair.

SUMMARY OF THE INVENTION

The present invention is a towel holder for use on lounge chairs which is configured to be secured in place on a chair strap or back. A second area of the holder includes a spring like grip portion for receiving the end of the towel and includes an upper cavity area for receiving and retaining the upper edge portion of the towel. The holder is configured at the cavity entrance to prevent withdrawal of the towel in a longitudinal direction once inserted. Removal of the towel is possible only by sliding the towel laterally within the holder. Thus, once the holder is in place, a towel may be secured to the lounge chair. Preferably the holders are used in pairs spaced as wide as possible on an upper strap of the chair. The holders are preferably formed of a resilient material such as nylon, Delrin or other suitable thermoplastic material with memory which permits limited flexing of portions of the holder relative to one another.

DESCRIPTION OF A PREFERRED EMBODIMENT

Figure 1:
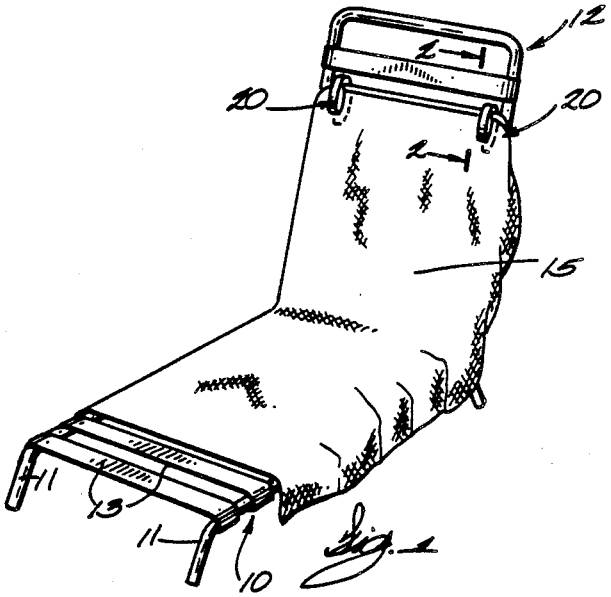
FIG. 1 is a perspective view of a chaise lounge and towel held in place with holders according to the invention.

As seen in FIG. 1, a typical chaise lounge chair 10 is shown which includes side or base frame members 11 and an upstanding pivotable frame portion 12 having a plurality of flexible straps 13 spanning the framework for supporting a person while seated or laying down. A towel 15 is shown in place on the chair secured by a pair of holders 20 whose detail is described hereinafter.

Figure 3:
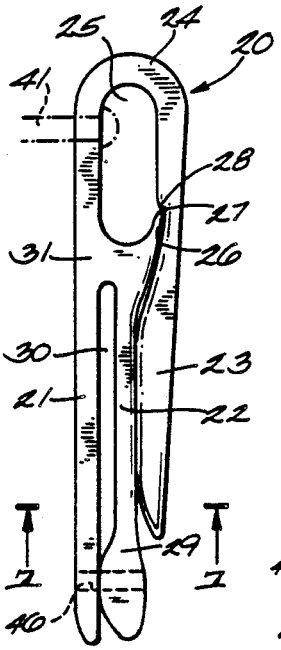
FIG. 3 is a side elevation of a holder according to the invention.
Figure 2:
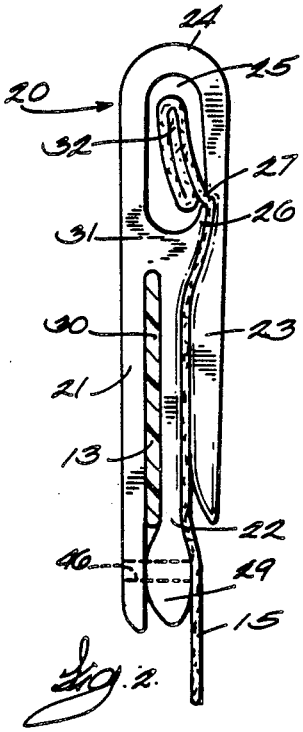
FIG. 2 is a view taken along line 2—2 of FIG. 1.

As seen in FIGS. 2 and 3, each holder 20 includes a back leg portion 21 spaced from a downwardly extending intermediate leg portion 22 and having a front securing leg portion 23. The front and rear legs of holder 20 are joined by a contiguous curved upper portion 24 forming a hollow interior cavity 25. The intermediate leg portion 22 between legs 21 and 23 extends up to form a concave bottom of cavity 25 which is formed to provide a holding ridge 26 protruding into a recess 27 formed in the inner surface of front leg 23 which also follows the contour of the adjoining intermediate member 22. Adjacent to and slightly above the holding ridge 26 recess 27 has an overlapping edge 28 which normally overlaps the ridge 26. The lower end of the intermediate leg 22 has an enlarged bottom portion 29 which is configured to contact the adjoining surface of back leg 21 thereby forming a strap retaining space 30 between legs 21 and 22 extending between the bottom 29 and an upper connecting area 31 joining the back and intermediate legs 21 and 22.

The holder 20 is formed of materials which are elastically deformable to permit the intermediate leg 22 to be deflected forwardly away from back member 21 for allowing the device to be slid over a chair strap 13 placing it within the space 30 as illustrated in FIG. 2. The front leg 23 is also deflectable relative to intermediate leg 22, and a towel end may be advanced longitudinally upward between members 22 and 23 until the towel edge portion 32 is received within the cavity 25 as seen in FIG. 2.

Figure 4:
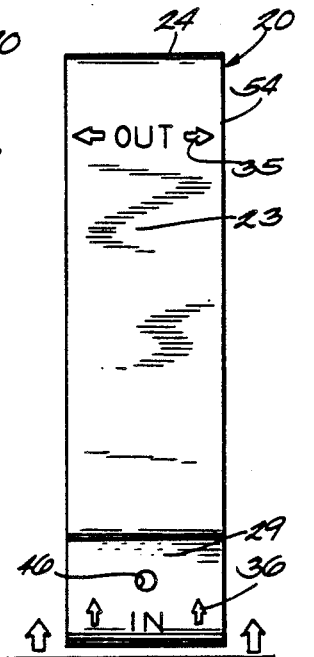
FIG. 4 is a front elevation view of a holder according to the invention.
Figure 7:
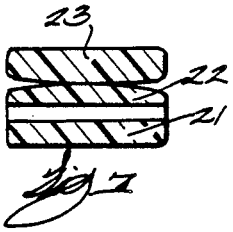
FIG. 7 is a view taken along line 7—7 of FIG. 3.

Once the towel 15 is advanced to place its edge 32 within the cavity 25, the overlap of edge 28 and holding ridge 26 of the cavity 25 makes it virtually impossible to remove the towel from the holder 20 by pulling it in a longitudinal direction. Instead removal is accomplished by sliding the towel 15 laterally from the holder 20. As seen in FIG. 4, the front of leg 23 may have arrows 35 indicating the direction for removal of the towel and members 22 may have arrows 36 indicating to users the method of inserting the towel into the holder 20. To facilitate the lateral removal of the towel from the holder, the mating surfaces of legs 2 and 23 may be beveled or rounded laterally as shown in FIG. 7.

Figure 5:
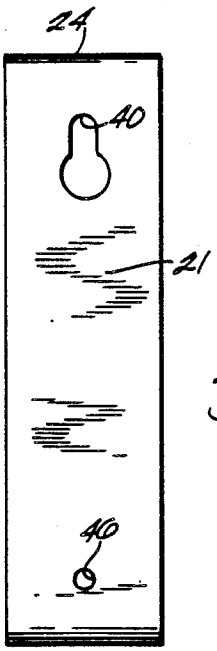
FIG. 5 is a rear elevation view of a holder according to the invention.

To make the unit adaptable to use on other types of chairs having relatively rigid back materials such as wooden slats or the like, the back of the holder 20 may have an inverted keyhole shaped aperture 40 extending through the rear and into cavity 25 as shown in FIG. 5. A conventional bolt or screw 41 shown in phantom in FIG. 3 could then support the holder by having the bolt head extending through aperture 40 and secured within cavity 25.

Figure 6:
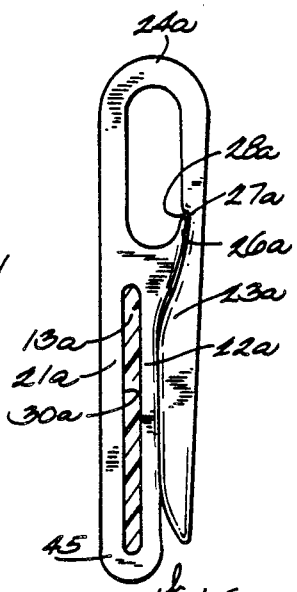
FIG. 6 is a side elevation of an alternate version of a holder according to the invention.

An alternate embodiment of the holder is shown in FIG. 6 where similar portions of the holder have been denoted by corresponding reference numerals with the suffix "a". Two of the basic elements of the holder, namely the legs 21*a* and 22*a* are used to form a strap retaining space 30*a*, however the back and intermediate legs 21*a* and 22*a* are joined at the bottom by a contiguous connecting loop 45 resulting in a fully enclosed space 30*a*. This type of holder would be permanently attached to a chair strap at the time of assembly of the chair by threading the strap 13*a* through the space 30*a* with the remaining components of the holder unchanged. Permanent affixing of the holder shown in FIGS. 2 and 3 could also be accomplished by simply sliding the holder onto a strap and riveting or otherwise securing leg members 21 and 22 together at their lower ends. A preformed hole 46 may be provided for this purpose.

The towel holders according to the invention are preferably molded of a resilient plastic type material such as nylon, Delrin or other suitable elastically deformable thermoplastics. Obviously other materials might prove equally suitable, however, injection or other molding of thermoplastics permits construction of the device in an economical and unitary fashion with no assembly required.

While a preferred embodiment of the invention has thus been described, those skilled in the art will appreciate that other variations of the design or construction of my towel holder would be possible without departing from the scope or intent of the invention which are as described in the claims which follow;

I claim:

1. A holder for securing towels or similar flexible sheet materials to a lounge chair comprising:

(a) said holder being generally elongated and having a front and back portion;

(b) first means for attaching said back portion to said chair;

(c) second means for receiving and retaining an end of a towel or sheet when inserted in a longitudinal direction and permitting removal laterally;

(d) said second means including an open bottom portion for receiving said towel or sheet inserted in a longitudinal direction;

(e) said second means including a downwardly extending first leg member biased into contact with a downwardly extending second leg member for receiving said towel or sheet between said second leg members;

(f) a cavity contiguous to the upper portions of said first and second leg members and spaced from said bottom portion for receiving the end of said towel or sheet; and (g) holding ridge means formed within said cavity for resisting withdrawal of said towel in a longitudinal direction once inserted between said first and second leg members into said cavity.

2. A holder as set forth in claim 1 including a third leg member forming the back of said holder, biased into contact with said second leg member and having a strap retaining space formed between said second and third leg members whereby said space may receive a supporting strap of said chair for securing said holder in place.

3. A holder as set forth in claim 2 wherein said holder is formed from an elastically deformable thermoplastic material.

4. A holder as set forth in claim 3 wherein said second and third leg members are contiguously joined to form said strap retaining space.

5. A holder as set forth in claim 4 wherein said first and second leg members each having laterally beveled mating surfaces.

6. A holder for securing towels or similar flexible sheet materials to a lounge chair comprising:

(a) said holder being generally elongated and having a front and back portion;

(b) first means for attaching said back portion to said chair;

(c) said second means for receiving and retaining an end of a towel or sheet when inserted in a longitudinal direction and permitting removal laterally;

(d) said second means including a downwardly extending first leg member biased into contact with a downwardly extending second leg member for receiving said towel or sheet between said first and second leg members;

(e) a cavity contiguous to the upper portions of said first and second leg members for receiving the end of said towel or sheet; and (f) holding ridge means formed within said cavity for resisting withdrawal of said towel in a longitudinal direction once inserted between said first and second leg members into said cavity.

7. A holder as set forth in claim 6 wherein:

(a) a third leg member forming the back of said holder, biased into contact with said second leg member and having a strap retaining space formed between said second and third leg members whereby said space may receive a supporting strap of said chair for securing said holder in place.

8. A holder as set forth in claim 7 wherein said second and third leg members are contiguously joined to form said strap retaining space.

9. A holder as set forth in claim 6 wherein said first and second leg members each having laterally beveled mating surfaces.

10. A holder as set forth in claim 6 wherein said holder is formed from an elastically thermoplastic material.

* * * * *